United States Patent [19]

Lachnit

[11] 4,060,955

[45] Dec. 6, 1977

[54] MACHINE FOR MECHANICAL PRODUCTION OF BRICK MASONRY

[75] Inventor: Wolfgang Lachnit, Thalfingen, Germany

[73] Assignee: Adolf Berglein, Hannover, Germany

[21] Appl. No.: 600,146

[22] Filed: July 29, 1975

[30] Foreign Application Priority Data

July 11, 1975 Germany ..... 2530973

[51] Int. Cl.[2] ..... E04G 21/14

[52] U.S. Cl. ..... 52/749; 214/6 A

[58] Field of Search ..... 52/749; 214/6 A, 6 G, 214/6 FS

[56] References Cited

U.S. PATENT DOCUMENTS

| | | | |
|---|---|---|---|
| 1,096,306 | 5/1914 | Kallberg | 52/749 |
| 1,606,001 | 11/1926 | Thomson | 52/749 |
| 1,686,279 | 10/1928 | Kaye | 52/749 |
| 1,843,092 | 1/1932 | Massen | 52/749 |
| 3,177,621 | 4/1965 | Demarest | 52/749 |
| 3,350,833 | 11/1967 | Larger | 52/749 |
| 3,438,171 | 4/1969 | Demarest | 52/749 |
| 3,659,392 | 5/1972 | Stoltz | 52/749 |
| 3,782,047 | 1/1974 | Stoltz | 52/749 |

FOREIGN PATENT DOCUMENTS

| | | | |
|---|---|---|---|
| 2,113,644 | 9/1972 | Germany | 52/749 |

*Primary Examiner*—Leslie Braun
*Attorney, Agent, or Firm*—Max Fogiel

[57] ABSTRACT

The invention relates to a machine for mechanical production of masonry of bricks arranged in courses and in an offset manner having a carrying and guide frame adapted to move on rails along the masonry to be produced, comprising a carrying and guide frame like carriage on rails disposed on the inside and parallel to said masonry to be produced, individual driving means for step-wise movement of said frame-like carriage on said rails, said frame-like carriage including a brick laying device at its front side, at its rear side a horizontal brick storage device for stacked bricks, and between said two devices in the center of said frame-like carriage a vertical shaft-like brick magazine, above said brick storage device a brick stack gripping and transporting device for conveying brick stacks from said brick storage device to said vertical shaft-like brick magazine. The latter has a lower outlet for an individual brick and is open at its rearside. Between said vertical shaft-like magazine and said brick-laying device a supply device for an individual brick is disposed. Above said bricklaying device a turning device is disposed and in cooperation therewith. For said two devices and the other means in cooperation therewith a lateral movement device, vertical guide rails, lifting means at the front side and at the rear side and a common overall control device for all mechanical working, operating, and transporting devices and their individual drives are disposed on said frame-like carriage.

15 Claims, 19 Drawing Figures

4
4
2
2
28
10
13i
27
27
13i
14a
14
14
14b
16
14a
27
27
14
13
11
18

MACHINE FOR MECHANICAL PRODUCTION OF BRICK MASONRY

THE PRIOR ART

Attempts have already been made to replace the extremely tedious time consuming production of brick masonry or masonry of other types of building blocks (for which in the present specification and claims the term brick is used) by hand using skilled workers by a more rational method of bricklaying which can at least in part be carried out mechanically. In this respect, however, such numerous further disadvantages and shortcomings caused finally the concrete slab to come to be adopted more and more, but which in fact is not desired by many persons giving orders for the production of buildings.

SHORT SUMMARY OF THE INVENTION

The aim of the invention is that of dealing with these disadvantages and shortcomings and the provision of an improved machine for mechanical production of brick masonry, which complies with all practical requirements using simple means and leads to many numerous advantages as regards cheap, accurate production of masonry in buildings or all different types with a small requirement as regards labour and time and with a few semiskilled workers using a continuous and direct method on the building site and a low space requirement.

This is achieved in accordance with the present invention on a common carriage and guide frame adapted to be moved in steps parallel to the inner side of the masonry to be produced on rails by individual control and driving means, all operating means and their individual drives being arranged upon said frame carriage. The frame carries on its rear side a horizontal plate-like palette for receiving a stacked supply of bricks and above this there is disposed a brick stack gripping and transport means for conveying brick stacks from the horizontal brick store means to a vertical shaft-like brick magazine in the centre of the frame. Adjoining this on the frame there is disposed a brick transport means for one respective brick from the lower end of the brick magazine towards a front bricklaying means, a brick cutting means and a brick moving means for the bricklaying means above the masonry to be produced.

On the front and rear side of the frame lifting devices are arranged and for each of the operating means individual drives are provided. The operating means and their individual drives are controlled and actuated in the sequence corresponding to the working sequence of all operating means by means of a main control means, also located on the frame, for all operating means and their individual drives.

The carrying and guide frame, constructed as a carriage or sled is preferably provided with control means, which via sensing means cooperate with means such as holes, depressions, projections, cams or the like, which are to be sensed and are arranged on the support rails with a spacing between them. These means take part in determining the length of the extents of movement, the stopping points during bricklaying and the respective duration of stopping of the frame carriage and the stopping points.

For the construction of corners in masonry the stepwise movement control of the carrying and guide frame is switched off and in place of it a stepping operating means is switched on for the bricklaying means on a guide and control rail arranged on the carrying frame.

In the case of buildings with several storys the masonry units are constructed story by story respectively about the space which is to be enclosed, starting from the lowermost story.

Furthermore, the invention offers the advantage that using it it is possible to construct masonry structures with the thinest possible mortar joints, something which is advantageous as regards strength, improved adhesion between the bricks, more rapid drying of the masonry and the reduced shrinkage of the masonry owing to drying out and furthermore improved thermal insulation can be achieved.

LIST OF SEVERAL FIGURES OF THE DRAWINGS

Further advantages and details of the invention will be gathered from the following description in conjunction with the drawings. In the drawing some embodiments of the subject matter of the application are shown diagrammatically.

Figure 3:
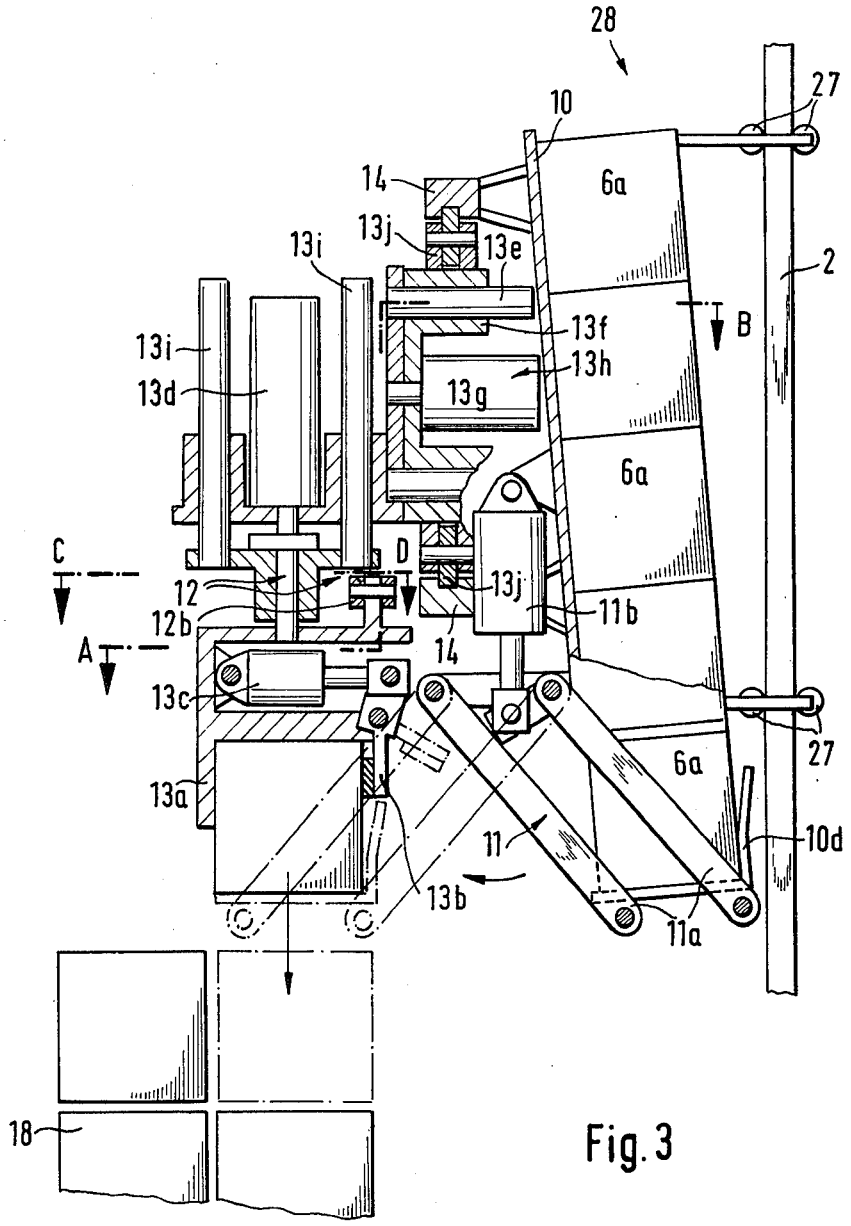
FIG. 3 shows an embodiment of the vertical brick magazine, of the individual supply means following the bricklaying means, and the latter on the front side of the support frame, as seen in sideview.
Figure 3A:
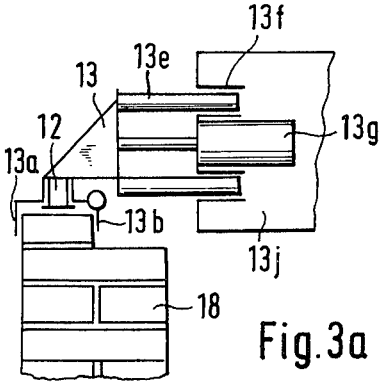
Figure 3B:
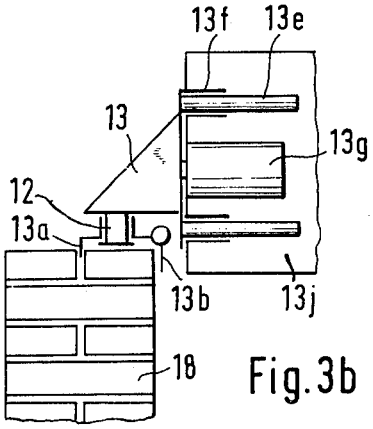

FIG. 3*a* shows an embodiment of an adjusting means for the bricklaying means with the latter above the outmost brick breadth of a composite unit of masonry.

FIG. 3 *b* shows the same embodiment with the bricklaying means above the inner brick breadth of a composite masonry structure.

Figure 4:
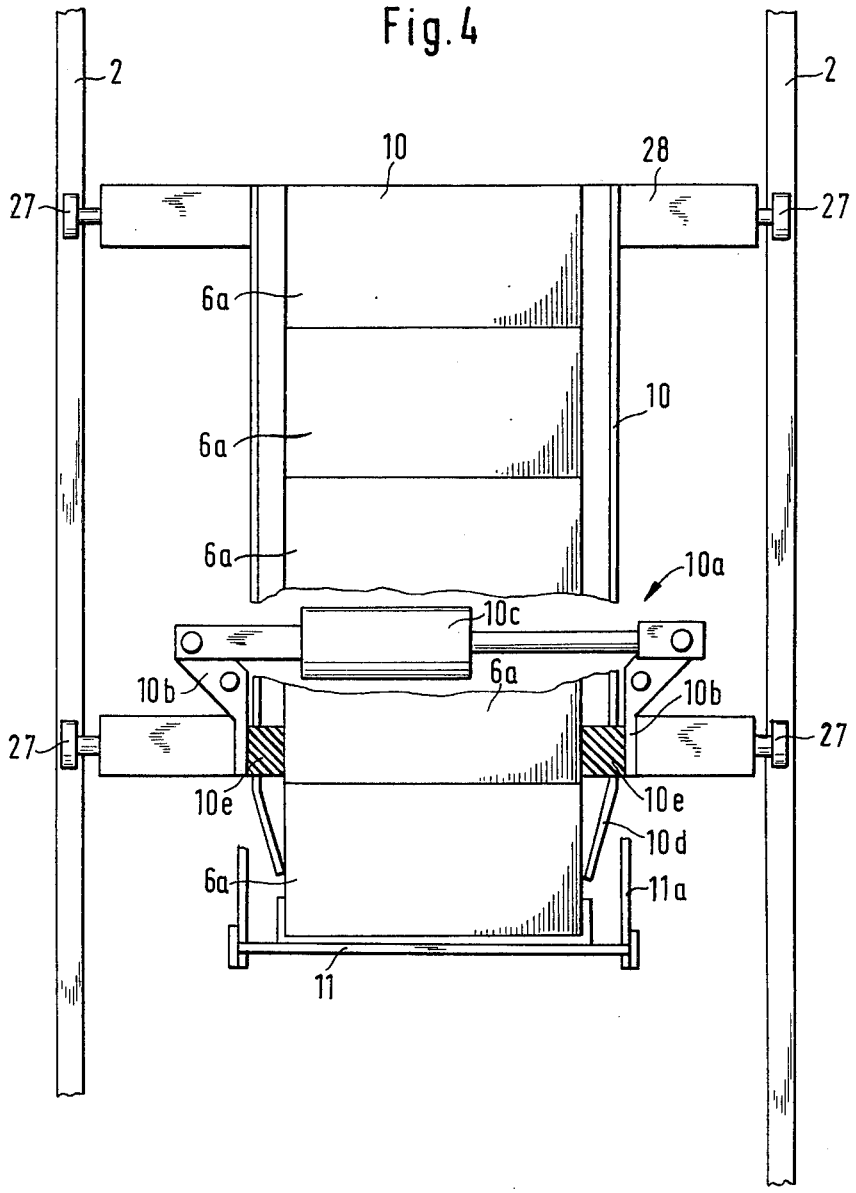

FIG. 4 shows the vertical brick magazine with the brick holding means and its lower end, omitting the parts lying in front of it of the machine, as seen from the front.

Figure 5:
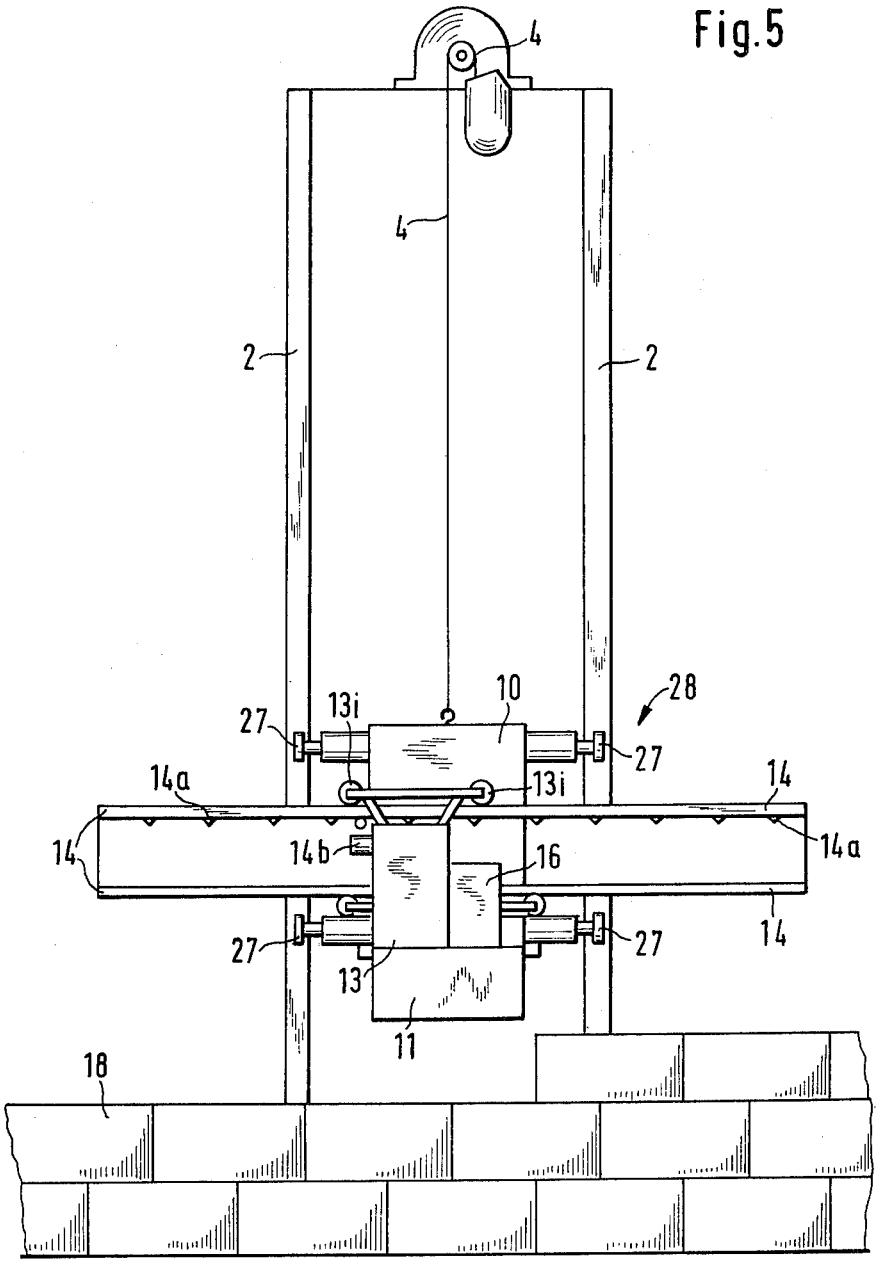

FIG. 5 shows an embodiment of a bricklaying means with a guide and control rail, extending beyond the sides of the machine, as seen in front view.

Figure 5A:
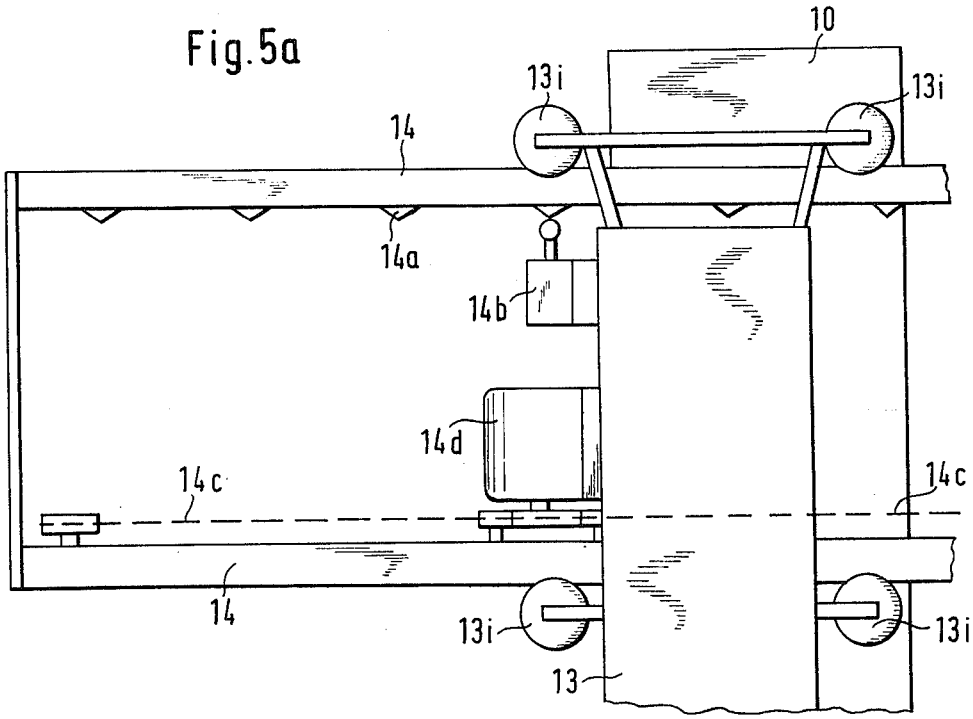
Figure 5B:
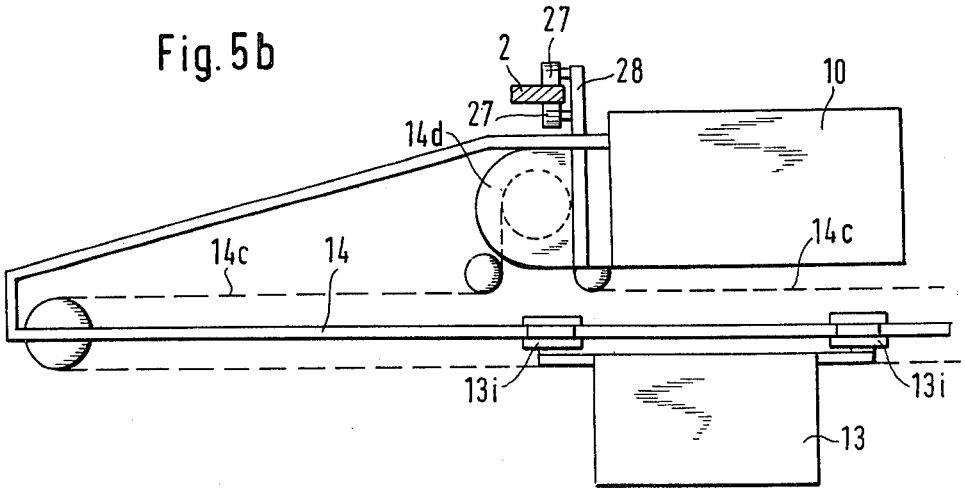

FIGS. 5*a* and 5 *b* show an embodiment of a bricklaying means with a horizontal guide and control rail extending beyond the sides of the machine, and the bricklaying means arranged on the rail, respectively as seen from the front and from above.

Figure 2:
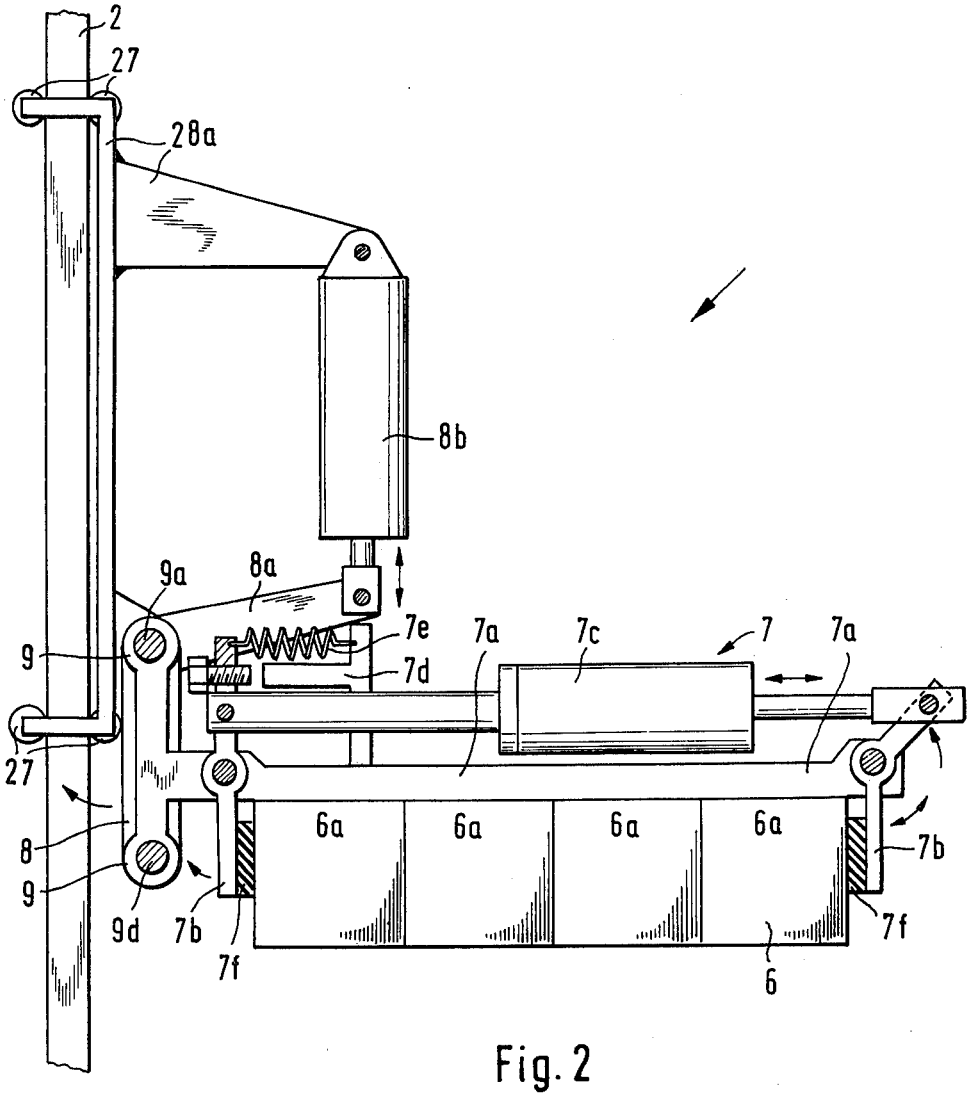
FIG. 2 shows an embodiment of the brick stacking gripping and transport means on the rear side of the machine above the brick storage means, as seen in sideview.
Figure 6:
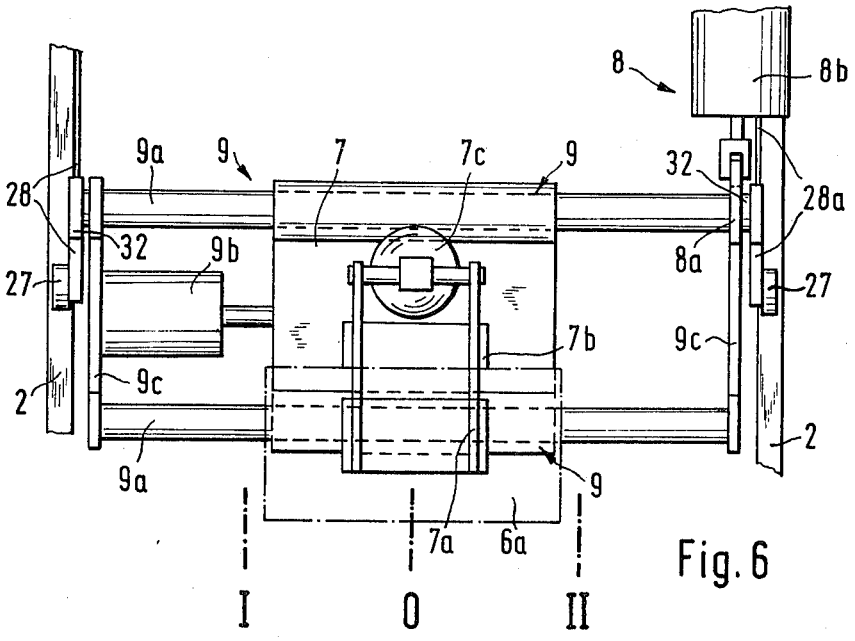

FIG. 6 is a view of the individual machine parts from their rear sides looking in the direction of the arrow "FIG. 6" in FIG. 2.

Figure 7:
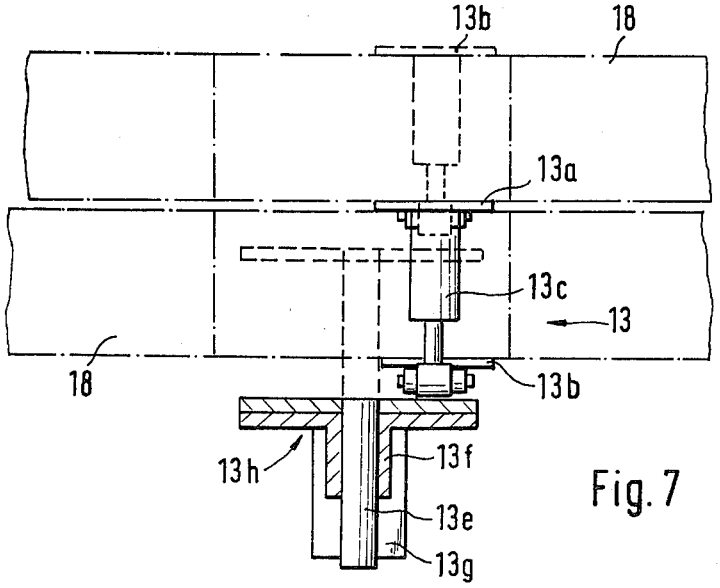

FIG. 7 shows a section through the bricklaying means on the line A–B of FIG. 3.

Figure 8:
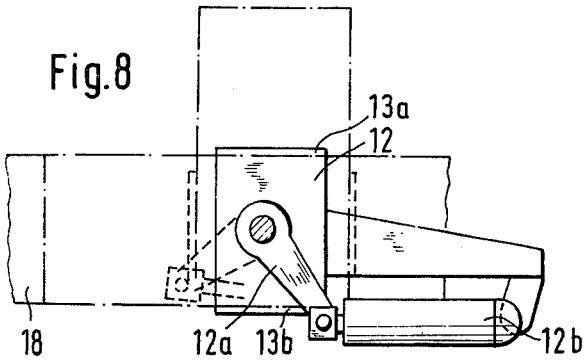

FIG. 8 shows a section through the bricklaying means on the line C–D of FIG. 3.

Figure 8A:
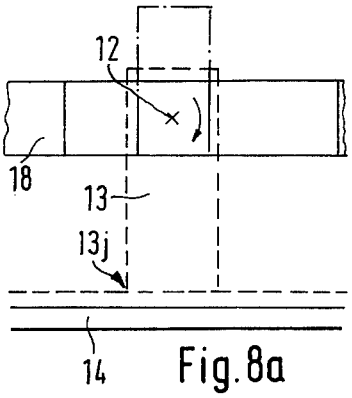

FIG. 8*a* shows an embodiment of a bricklaying means with the brick engaged between the left end and the longitudinal center, in planview in a position before the rotation through 90° for laying a transversely directed brick in a composite masonry structure.

Figure 8B:
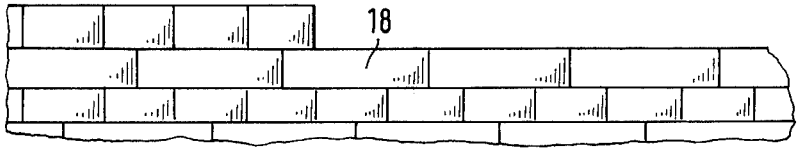
Figure 8C:
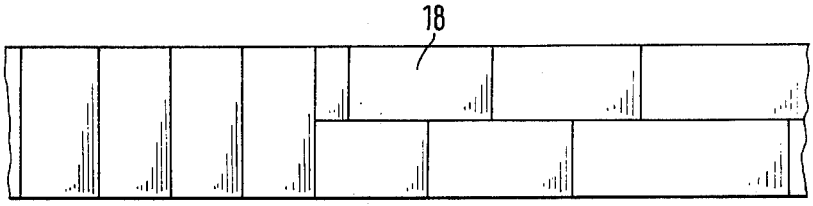

FIG. 8*b* and 8*c* show an embodiment of a compound masonry structure in sideview and from above.

Figure 9:
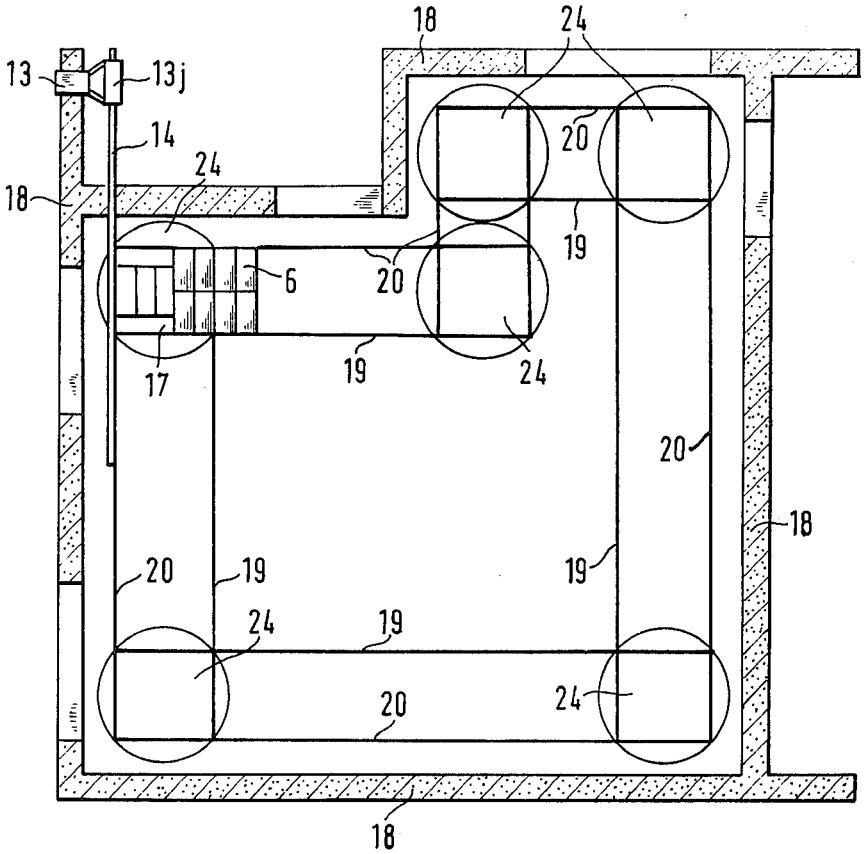

FIG. 9 shows an embodiment of a room masonry structure to be produced with the support rails laid and the machine adapted to move on them, as seen in planview.

Figure 10:
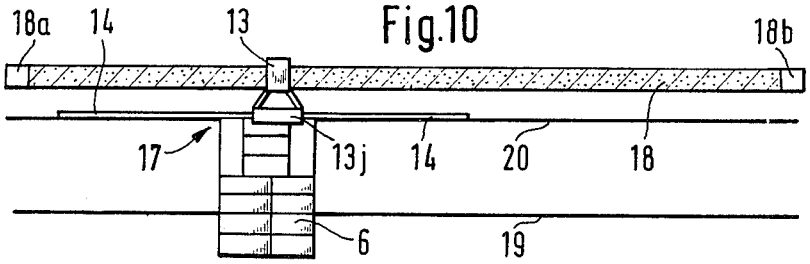

FIG. 10 shows an embodiment of the machine with the support rails in the case of the production of a masonry structure between two pillars, in planview.

Figure 11:
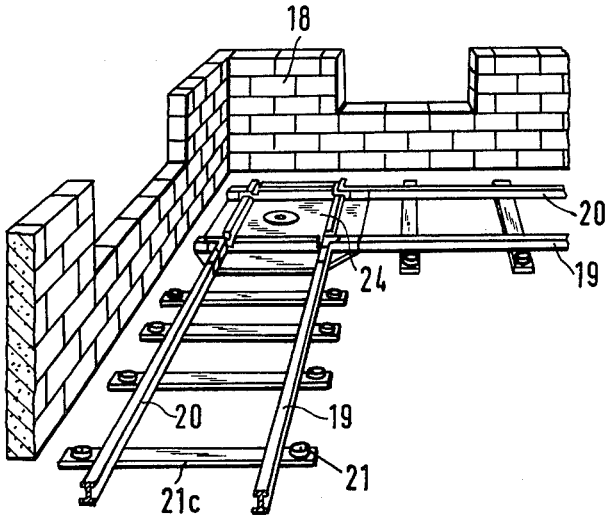

FIG. 11 shows an embodiment of a brick masonry structure running rectangularly, with window openings and a support rails system, which in the corner comprises a turntable arrangement, as seen in perspective.

Figure 12:
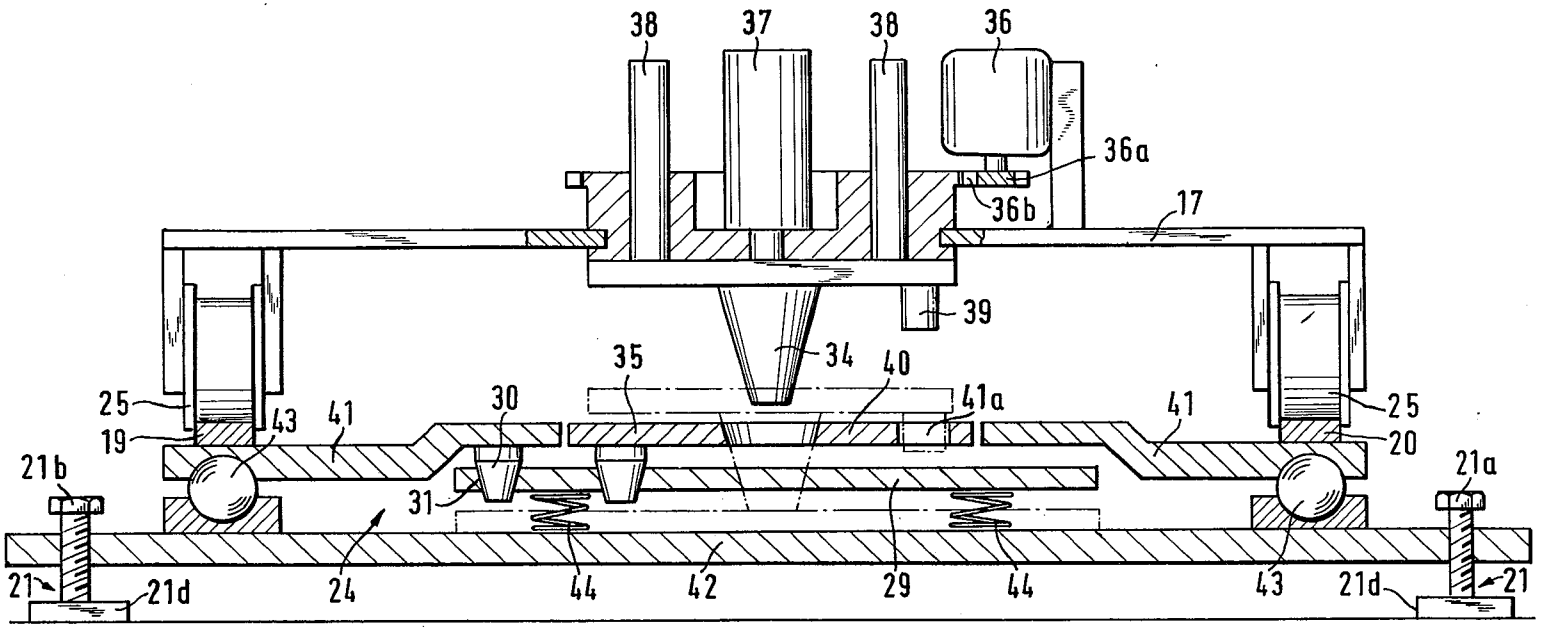

FIG. 12 shows an embodiment of a turntable arrangement with a lower part of the carrying and support frame of the machine in sideview, partly in vertical section.

DESCRIPTION OF PREFERRED EMBODIMENT

Figure 1:
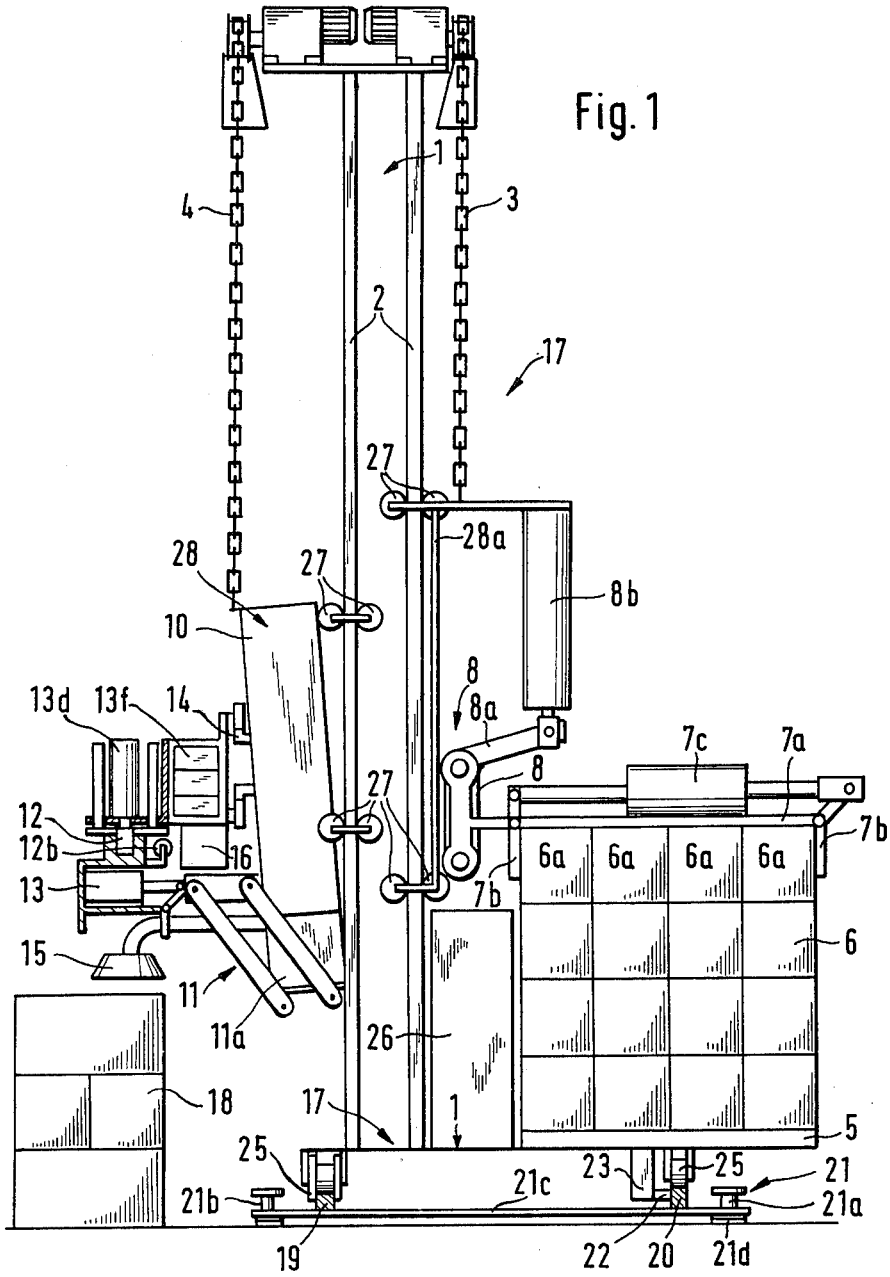
FIG. 1 shows an embodiment of the principle parts of the overall machine with lifting means, as seen in sideview.

In FIG. 1 and FIG. 2 reference numeral 1 denotes the conveying and support frame having four vertical guide rails 2 for rolls of a rear lifting means 3 and a front lifting means 4, and a brick storage plate 5 which is arranged horizontally and in the form of a palette. Reference numeral 6 shows a brick store stacked on it on the rear of the carrying frame 1.

The rear lifting device 3 is provided for the brick store 6, a brick stack gripping and transport means 7 with clamping jaws **7*b* and hydraulic cylinder 7*c*, the pivoting movement means 8 with the associated hydraulic cylinder 8*b* and the rear lateral movement means 9 for the parts 7 to 8**.

The front lifting means 4 carries the shaft-like brick magazine 10 which is arranged inclined somewhat towards the front in respect to the vertical. The magazine 10 is provided with a lower closing device or holding device **10*a*, with clamping jaws 10*b*, sheet metal guides 10*d* for the bricks, and the hydraulic cylinder 10*c*. The approximately vertical brick magazine 10 on the side of the masonry to be produced is followed by an individual brick transport device 11 with a bascule lever means 11*a* and a hydraulic cylinder 11*b* as individual driving means. The transport device 11 takes an individual brick from the brick magazine 10 at the lower end of the latter and conveys it towards the front bricklaying means 13 with the clamping jaw arrangement 13*a* and the hydraulic cylinder 13*c*** as individual drive.

The brick setting means 13 is provided with a twisting means 12 with associated hydraulic cylinder **12*b* as individual driving means and the two can be adjusted or moved on a horizontal guide and control rail 14. The guide and control rail 14 has control means or ramps 14*a* and a limit switch 14*b*. On the guide and control rail 14 the bricklaying means 13 and the twisting means 12 may be moved together with a lateral displacement carriage 13*j* when corners of the masonry (as shown in FIG. 9) towards one of the opposite sides have to be set. In this respect the sensing means 14*b* and the limit switch in conjunction with the control device for the step-wise movements determine the displacement of the carriage 13*j* with the bricklaying means 13** towards the respective side.

For the lateral movement of the laying means on the carriage **13*j*** a chain drive (FIG. 5*a*), a gear wheel drive or the like **14*c* is provided which has an individual drive 14*d***.

The construction of corners of masonry is carried out in step-wise movement of the bricklaying means 13 with the turning means 12 and each brick farthest removed from the machine is laid by movement of the bricklaying means 13 to the side on the guide rails 14. The bricklaying means 13 then travels back to the brick receiving point opposite the magazine 10, takes up a brick, travels to the next setting point, and places it adjacent to the previously laid brick of the corner masonry. This operation is repeated until the corner masonry structure is completely laid and the turntable 24 with the frame carriage 17 is turned for 90° to produce the following masonry of the corner until the next straight lined masonry begins. At the beginning of the masonry the stepwise movement of the whole frame carriage 17 is carried out again by using the stepwise movement means of the frame carriage 17 via the support rail sensing means after the stepwise movement means with the guide and control rail 14 for the bricklaying means 13 has been switched off.

In the case of masonry with mortar joints adjacent to the bricklaying means 13 a mortar applying or injection device 15 is arranged, which via flexible tubes is connected with a mortar supply means of known construction on the support or carrying frame 1. This mortar applying or injection means 15 is preferably arranged laterally displaced from the setting means 13 by a distance corresponding to half the length of brick. In this respect it is possible to use the means 15 to inject mortar into the joint of the underlaying course of bricks and during the movement of the machine to the next brick, into the joint for the next brick to be laid on the underlaying course of bricks.

For the occasional cutting to produce part bricks at the ends of masonry structures adjacent to the bricklaying means 13 a brick cutting means 16 can be provided which produces quarter length, half length or three quarter length bricks by means of a saw, cutting nippers or the like and this cutting device is controlled together with its individual drive automatically from the overall control means 26.

The carrying and guide frame 1 constructed as a carriage or sled 17 runs with flanged wheels 25 on parallel support rails 19 and 20, laid at the inner side of the masonry 18 to be constructed and parallel thereto. The running rails 19 and 20 rest in turn of sleepers **21*c* and on bottom plates 21*d* with threaded rods 21*a* and 21*b* for vertical adjustment and alignment of the rails 19 and 20**.

The support surface or ground surface should be as flat as possible. Any lack of evenness can, however, be compensated for by means of the setting means 21.

At the corners of the masonry in the support rails 19 and 20 turnable arrangements 24 are provided which are also capable of being vertically adjusted and aligned.

The step by step movement of the frame carriage 17 in one of two opposite directions on the support rails 19, 20 by means of an individual drive for the flanged rail wheels 25 is controlled via the support rails 19, 20, in which holes, depressions, cams or the like 22 are arranged. The latter are sensed by sensing means 23 on frame carriage 17. This stepwise movement control means on the support rails 19, 20 is detected by an overall control means 26 of the machine.

By means of the means 22 to be sensed and their spacing from each other the duration of stopping of the frame carriage 17 during laying of bricks, the beginning and the end of each part path movement of the frame carriage 17 in accordance with the respective size of the brick is determined.

On the side of the machine adjacent to the masonry to be erected, the front lifting means 4 carries the brick magazine 10 with front locking means **10*a* having a clamping jaw arrangement 10*b*, the individual brick transport means 11 with the bascule lever means 11***a* and the hydraulic cylinder 11*c* as individual drive, the bricklaying means 13 with the clamping jaw arrangement 13*a*, the turning means 12 with the hydraulic cylinder 12*b* as individual drive, and the control and guiding rail arrangement 14. All these devices and parts are arranged on a carriage 28, which is guided with rollers 27 on the front vertical guide rails 2.

The lifting device 3 on the rear side of the frame carriage 17 carries a carriage 28*a* guided with rollers 27 on the rear vertical guide rails 2 and on this carriage 28*a* a frame-like carrier 9*c* having parallel sliding spindles 9*a* with rotary pins 32 is pivotally disposed.

On the parallel sliding spindles 9*a* a sled-like lateral movement means 9 is slidingly disposed which is adapted to slide laterally into three positions I, 0, and II. On the sled-like lateral movement means 9 the carrying arm 7*a* of the stack gripping and transporting means 7 is fixed in a rigid manner. The sled-like lateral movement means 9 comprises a lever arm 8*a*, on whose free end the piston of the hydraulic cylinder 8*b* as individual drive engages in order to rotate the pivoting carriage 8 in its center position with the stack gripping and transporting means 7 attached to it and the brick stack located in it towards the side of the wall to be erected and downwards through 90°. In a corresponding vertical position of the lifting means 3 the brick stack in the stack gripping and transporting means 7 is deposited in the vertical brick magazine 10 by loosening the clamping means 7*b*.

For the lateral displacement means 9 of the pivoting carriage 8 into its center pivot position 0 and for receiving lateral brick stacks in the lateral position I or II on the pivoting carriage 8 a hydraulic cylinder 9*b* as individual drive is arranged (FIG. 6). Since on the brick store means 5 the bricks are arranged in several stacks lying alongside each other at the beginning of operation of the machine firstly the pivoting sled 8 is to be brought into the position corresponding to the brick stack to be engaged on the brick stack supply or storage palette 5 and accordingly the pivoting sled 8 is to be moved into position 0.

Following this the brick stack gripping and transport device 7 engages the brick stack by opening and closing of the clamping jaws 7*a* and the gripping means 7 is moved somewhat upwards by the lifting means 3. Following this the pivoting sled 8 with the brick stack gripping and transport means 7 is swung downwards and forwards through 90° in order after a suitable vertical setting of the brick stack opposite the brick magazine 10 to be deposited in the brick magazine 10, open to the rear, by spreading of the clamping jaws 7*a*.

Following this the pivoting sled 8 is moved back again into the position above the brick store 6 and is actuated again when bricks are again required for the brick magazine 10.

The bricks 6*a* in the store 10 slide respectively after the removal of the lower brick in a downward direction and make possible a low constructional height of the brick magazine 10 and a low centre of gravity of the whole arrangement. The brick holding means 10*a* with the clamping jaws 10*b* and the hydraulic cylinder 10*c* as individual drive holds the brick column in the brick magazine 10 apart from the brick which is just taken up by the individual transport means 11. When this brick is transported to the bricklaying means 13 the transport means 11 is moved back into the catching position underneath the brick magazine 10.

The brick setting or laying means 13 is provided with a stationary clamping jaw 13*a* and with a pivoting clamping jaw 13*b*, which is moved by a hydraulic cylinder 13*c* as individual drive.

By means of the front lifting means 4 the brick located in the bricklaying means 13 is placed on the brick course which has previously been laid and pressed against it after the previous application of a mortar layer on the previously produced brick course.

If necessary the bricklaying means 13 can be moved with the brick located in it on its control and guide rail 14 for laying a double brick on the brick wall 18 by a distance corresponding to the breadth of a brick in a forward direction by means of the displacing means 13*a* in order to produce a double thickness masonry structure of a composite masonry structure. For the same purpose above the bricklaying means 13 on the latter a turning means 12 is arranged having a hydraulic cylinder 12*a* as individual drive.

The control and guide rail 14 carries the bricklaying means 13 and the turning means 12 in a laterally sliding manner or in such a manner that they can be moved on rollers. The control and guide rail 14 is provided at its ends, projecting beyond the frame carriage 17, with cams 14*a*. The latter are sensed by a sensing part 14*b* located on the brick setting device 13, when the bricklaying means 13 with the turning means 12 (for constructing masonry corners) is to be moved as such for the laying of bricks in corners (for example three) in steps in a lateral direction (FIG. 5). For this purpose the bricklaying device 13 must be moved back respectively after the laying of each brick each time into its brick receiving position, with respect to the individual brick transport means 11 in order at this position to accept a new brick. This new brick is then after a step by step sidewise movement of the bricklaying device 13 on the control and guide rail 14 deposited adjacent to the brick already laid on the corner of the masonry structure. The bricklaying means 13 returns then back into its brick catching position in order to take up a new brick.

In the case of these steps involved in the construction of a corner of a masonry structure the frame carriage 17 is located on the middle of the turntable 24 provided at the corner of a masonry structure. The step by step movement control of the frame carriage 17 by means of the step by step control on the support rails 19, 20 is switched off and correspondingly the step by step control for the bricklaying means 13 on the control and guide rail 14 is switched on.

The machine moves on flanged wheels 25 on the support rails 19, 20, which at the same time assure the production of aligned walls. The step by step movement of the machine can occur in two opposite directions as for example in the case of walls between two supporting carriers 18*a*, 18*b* (FIG. 10). The step by step movement of the frame carriage 17 and the bricklaying means 13 makes it possible to employ one brick breadth in the case of composite masonry and double masonry and in the case of normal masonry it is possible to employ two brick breadths after two switching steps in the case of straight extents.

For the adjustment of the bricklaying means 13 with the turning device 12 arranged above it by a distance corresponding to the breadth of one brick towards the wall 18 on the bricklaying means 13 a sliding shoe 13*e* is provided which fits to a horizontal sliding guide 13*f* of the guide and control rail 14 and in its interior a hydraulic cylinder 13*g* as individual drive for the sliding shoe 13*e* is disposed. With this hydraulic cylinder 13*g* the bricklaying means 13 with the bottom wall of the sliding guide 13*f* as a counter abutment surface is moved forward before the laying of the respective brick through a distance corresponding to the breadth of one brick and after the laying of this brick it is returned into the original position. This additional means and its application is necessary in the case of double masonry or in the case of composite masonry in order respectively alternately in one brick course or in subsequently following brick courses, to lay the bricks in pairs in the longitudinal direction of the masonry alongside each other and in the transverse direction with respect to the masonry at one respective step-wise position of the frame carriage 17 or of the bricklaying means 13.

For the bricks laid in pairs transversely in the turning means 12 is turned during each switching step through the breadth of a brick and through 90°.

Since the bricks are engaged in the bricklaying device 13 by the clamping jaws 13*a*, 13*b* of the latter always in the middle between an end and the longitudinal middle of the brick, the laid bricks then lie above the brick half below the bricklaying means 13 and above the brick half extending towards the outside. By the turning through 90° the bricks laid and two adjacent stepping positions come to lie adjacent to each other in the longitudinal direction. In the case of these operations for the laying of a composite masonry structure the step control of the frame carriage 17 or of the laying means 13 (at the corners of the masonry structure) always occurs with a distance corresponding to the breadth of a brick or half the length of a brick. In the case of normal masonry with one brick in the longitudinal direction of the latter in the case of each laying of a brick two operating steps are carried out each corresponding to the breadth of a brick.

The working operations automatically controlled by a programming means or another means such as an electronic overall control, are carried out as follows after setting the rear side setting means 9 to the position, which corresponds to the brick stack lying underneath the gripping means 7 on the brick store carrier 5 and after movement back of the lateral movement means 9 into the position 0, that is to say (for example):

The brick gripping and transport means 7 with the brick stack carried by it is raised with the rear lifting means 3 until it is free from the operating means lying underneath it. Then the brick gripping and transport means 7 is swung downwards and forwards through 90° and brought into a vertical position in which the brick stack carried by it moves to lie against the rear open side of the brick magazine 10. By opening the clamping jaws 7*b* the brick stack is released and deposited in the brick magazine 10. The brick stack is held in the brick store 10 by a holding means 10*a* with the clamping jaws 10*b* until the lowest brick 6*a* drops into the individual brick transport means 11 and is supplied by the latter with the bascule lever 11*a* to the bricklaying means 13 and is taken up by the latter with the clamping jaws 13*a* and 13*b*.

Following this the brick is laid by lowering the bricklaying means 13 and spreading the clamping jaws 13*a*, 13*b* to release the brick.

On laying the bricks in a normal course of bricks in the longitudinal direction of the masonry structure for each bricklaying operation two switching steps must be carried out in the breadth of the brick.

If the corner of the masonry structure are to be constructed with the frame carriage 1 on the middle of a turntable 24, the step control of the frame carriage 17 is switched off via the supporting rails 19, 20 and instead of it the step control for the bricklaying means 13 is switched on via the guide and control rail 14. For the corners of masonry only the bricklaying means 13 is moved with operating steps respectively to the next bricklaying position in the corner of the masonry and is brought into position for laying the brick. Following this the bricklaying means 13 is moved back to the brick receiving position opposite to the individual brick transport means 11 for receiving a new brick and at this position takes up a new brick. This brick is brought with the same stepping movements of the laying means 13 to the next laying position in the corner of the masonry. Following this the bricklaying means 13 is moved back with stepping movements again to the brick receiving position and the operations are repeated until the corner brickwork is completely laid. After this has been carried out the turntable 24 and the frame carriage 17 is turned through 90°. Following this the bricklaying operations are repeated for the remainder of the corner masonry running at an angle of 90°, in the same manner, with the only difference that the frame carriage 17 is turned through 90°. When the whole corner of the masonry is completed the step-wise movement control of the bricklaying means 13 via the guide and control rail 14 is switched off, and the step-wise movement control of the whole frame carriage 17 via the support rails 19, 20 is switched on, until the next corner of the masonry is reached. The further brick laying for the straight-lined masonry is performed in the described normal manner with two operating steps carried out in the breadth of a brick for each bricklaying operation.

In the case of the production of composite masonry in addition to the above mentioned operating means further operating means with their individual drives are necessary and employed.

On laying bricks in brick courses with alternating parallel bricks, laid in pairs, adjacent to each other in the longitudinal direction of the brickwork and in a transverse direction the bricklaying operation is carried out as follows:

After a brick has been conveyed by the individual brick supply means 11 and has been received by the bricklaying means 13 and laid by it, before the laying of the next brick the bricklaying means 13 is moved forwards by the projecting sliding piece 13*e* and the hydraulic cylinder 13*g* as individual drive on the guide and control rail 14 about the breadth of one brick and in this position bricklaying is carried out. Then two bricks are laid in the longitudinal direction of the masonry adjacent to each other.

On laying bricks in pairs in the transverse direction of the masonry per operating step in the brick breadth the first brick is engaged by the bricklaying means 13 and the latter is turned with a brick through 90°, for which purpose the turning means 12 is controlled and actuated. Since the brick is engaged by the clamping jaws 13*a*, 13*b* at the position between one end and the longitudinal middle of the brick, the latter on the 90° turning is laid with one half underneath the bricklaying means 13 and with the other half projecting forwards so that it comes to lie transversely with respect to the masonry. On the following operating step through the breadth of a brick the next brick is turned in the same manner through 90° again and also comes to lie transversely adjacent to the brick which was previously laid. These operations are repeated on bricklaying in compound masonry courses.

The turntables 24 of the rail systems 19, 20 make possible a turning or pivoting of the whole frame carriage 17 into the desired working direction, for example through 90° or a through a larger angle. The turning is in this case preferably brought about with a coupling arrangement having a coupling part 34 on the frame carriage 17 and a coupling part 35 on the turntable 24 (FIG. 12). The rotary drive means 36 is preferably provided with an individual drive motor acting via a gear wheel 36*a* and a gear ring 36*b* on the frame carriage 17 (see FIG. 12).

The coupling arrangement is preferably provided with conical members 34, 35 which make possible ready introduction of the coupling member 34 on the carriage 17 into the coupling member 35 on the turntable 24 (see FIG. 12).

The coupling part 34 journalled on the frame carriage 17 has a parallel lateral entraining member 39, which on pressing down of the coupling part 34 by means of the hydraulic cylinder 37 snaps into position in the inner plate 40 of the lower part 42 of the turntable 24.

Furthermore the coupling part 34 presses the intermediate plate 29 of the rotary turntable 24 downwards and accordingly brings the detent pin 30 out of engagement with the intermediate plate 29.

The turntable individual drive means 36 can now turn and set the upper part 41 of the rotary turntable 24 with the frame carriage 17 on it in accordance with specific requirements. After setting by turning has been completed the detent pin 30 snaps into one of the holes 31 provided in the intermediate plate 29 and so secures the frame carriage 17 on the turntable 24 against any further, unintentional turning. The bearing 43 of the turntable 24 is provided with ball bearings or roller bearings.

The intermediate plate 29 is pressed upwards by compression springs 33 after coming into position of the coupling member 34.

The inner plate 29 of the turntable 24 is connected in a non-rotary manner with the base plate 42 of the turntable 24.

The control of the frame carriage 17 can be carried out manually as a following control or preferably by means of electronic and program control means.

The drive of the frame carriage 17 and the individual operating means can preferably be pneumatic, hydraulic and/or using an electric motor.

With the machine in accordance with the invention it is possible to lay bricks of any desired size, the term of brick in the present specification and claims being understood in this context to mean normal baked bricks, large building blocks, hollow building blocks with cavities into which mortar is cast or the like. The individual operating means are to be adapted to suit the respective size of the bricks. The same applies for the individual working steps and the individual brick grippers, conveying means and the laying means and the respective working times and their sequence. In this respect the individual operating means and their dimensions can be constructed for receiving bricks of different sizes in an adjustable manner.

Since the production of the masonry of the individual rooms of the building structure is carried out story by story, each story being open in an upward direction, it is not necessary to provide scaffolding and in this respect it is not necessary to take account of the height of the machine.

The palette 5 with the stacked brick store 6 can be placed on the machine with conventional cranes and the bricklaying can be automatically controlled in accordance with a program on the machine which has previously been switched on. Owing to the firm connection of the brick store 6 located on the palette 5 with the machine, its center of gravity is made as low as possible and this is advantageous, so that the machine has a stable position on the rails 19, 20 and can be moved comparatively fast in steps, this making it possible to carry out rapid work.

If supply of mortar is necessary, the supply can be easily be arranged for using known means with switching on of the mortar supply in the respective working rhythm.

The case of any necessary use of half bricks or three quarter bricks it is possible for the brick cutting device 16 provided for this purpose to be arranged on the bricklaying means 13 and it can also be controlled by the programming means to bring it into the corresponding brick position.

With the turning means 12 which is also automatically controlled, on the bricklaying means 13 it is possible for the respective brick located in it to be turned through 90° and it is thus possible to produce composite masonry. Furthermore the bricklaying means 13 can be set rectangularly to the masonry to be produced, something which can be automatically controlled.

In order to produce double masonry without or with a wall cavity, the bricklaying means 13 can be moved forward by means of the side displacing means 13*e* – 13*g*.

The automatic control of all working steps of the individual working means can be easily set and carried out with known program translating means electronically or the like, with punched tape, magnetic tape or the like in a simple and easy manner so that very little operating and monitoring labor is necessary at the building side, since the individual operations are determined in accordance with drawings of the building and are laid down in accordance with punched cards, punched tapes, magnetic tapes or the like for the control means.

The embodiment which has been shown and described of the invention can be modified in accordance with adaptations necessary for individual practical cases as regards individuals of the construction without these numerous possible modifications causing one to leave the scope of the invention.

What I claim is:

1. A machine for the mechanical production of masonry of bricks arranged in courses and in an offset manner having a carrying and guide frame adapted to move on rails along the masonry to be produced, comprising a guide frame-like carriage, on supporting rails disposed at the inside of said masonry and containing all working devices and their drives, said frame-like carriage including individual driving means for step-wise movement of said frame-like carriage on said rails and having a brick laying device at its front side and a horizontal brick storage device for stacked bricks at its rear side, and between said two devices in the center of said frame-like carriage a vertical shaft-like brick magazine, above said brick storage device a brick stack gripping and transporting device for conveying brick stacks from said brick storage device to said vertical shaft-like brick magazine, the latter having a lower outlet for an individual brick and being open at its rearside, a supply device for an individual brick from said lower outlet of said brick magazine to said brick laying device, a turning device above said brick laying device and in cooperation therewith, a lateral movement means for said brick laying device and said turning device, and vertical guide rails and lifting means at the front side for said brick laying device, said turning device and said vertical shaft-like magazine, vertical guide rails and lifting means at the rear side for said brick storage device, said brick stack gripping and transporting device, each of all mechanical working, operating, transporting and lifting devices and means having individual drives and a common overall control device for all mechanical operating devices which is also disposed on said frame-like carriage.

2. A machine as per claim 1 in which on said vertical guide rails at the front an additional carriage is vertical movably disposed carrying said vertical shaft-like magazine, said brick laying device, said turning device, said brick supplying device between said vertical brick magazine and said brick laying device and a horizontal guide and control rail for lateral movement of said brick laying device and said turning device relative to said guide and control device and in cooperative connection with said lifting device on the front.

3. A machine as per claim 2 in which between said guide and control rail and said brick-laying device and said turning device scanning means are provided at one of said two devices relatively movable to each other and sensing means at the other of said two devices and an individual drive for said relative movement is provided for step-wise lateral displacement of said brick-laying device and said turning device when said frame-like carriage has reached a corner of the masonry.

4. A machine as per claim 1 in which on said vertical guide rails at the rear side of said frame-like carriage an additional carriage and thereupon a device for supplying and a device for horizontal movement on said brick stack gripping and transporting device and said brick stack storage device is disposed in cooperation with said rear lifting means.

5. A machine as per claim 4 in which said brick stack gripping and transporting device is pivotally mounted on said turning device which is slidably mounted on said carriage guided by means of rollers on said rearward vertical guide rails and in coperating connection with said rearward lifting means.

6. A machine as per claim 5 in which at said carriage at least two parallel guide spindles are rigidly mounted on which said turning device is lateral shiftingly disposed.

7. A machine as per claim 6 in which said turning device for its shifting movement on said guide spindles is provided with separate individual driving means.

8. A machine as per claim 1 in which between said guide control rail and said brick-laying device and said turning device guide and control means are provided for displacement of said brick laying device and said turning device rectangularly to said horizontal guide and control rail.

9. A machine as per claim 8 in which between said frame-like carriage and said turnables, a preferable conical disengageable coupling arrangement is provided, guided, actuated and controlled by controlling and driving means disposed on said frame-like carriage.

10. A machine as per claim 1 in which between said frame-like carriage and said support rails for said carriage at one of them spaced sensing means and at the other of them spaced scanning means are disposed cooperative with each other and with an individual driving means for said step-wise motion of said frame-like carriage and said rails are provided by which the length of the parts of displacement of said frame-like carrier, their beginning, their termination and the duration of stopping of said frame-like carriage during brick-laying is determined.

11. A machine as per claim 1 in which as a common overall control means for all mechanical working and operating means and their individual drives on said frame-like carriage a programming or an electrical control is disposed.

12. A machine as per claim 1 in which at the lower end of said vertical brick magazine a brick holding means having clamping jaws for the bricks and a hydraulic cylinder as individual drive for holding device and its jaws are provided.

13. A machine as per claim 1 in which said carrying rails of said frame-like carriage at the corners of the masonry to be produced are provided with turnables.

14. A machine as per claim 1 in which said brick-laying device includes lateral jaws for gripping the individual brick applied to it and its jaws are so constructed and arranged that they engage the brick supplied to them at a lateral position between one end of the brick and of its longitudinal middle.

15. A machine as per claim 1 in which said vertical shaft-like brick magazine is open at its rearside and somewhat inclined to the front at its upper end.

* * * * *